United States Patent [19]

Watts

[11] Patent Number: 4,718,870

[45] Date of Patent: Jan. 12, 1988

[54] MARINE PROPULSION SYSTEM

[75] Inventor: Leonard Watts, North Miami Beach, Fla.

[73] Assignee: Techmet Corporation, Greenwich, Conn.

[21] Appl. No.: 800,102

[22] Filed: Nov. 22, 1985

Related U.S. Application Data

[63] Continuation of Ser. No. 466,657, Feb. 15, 1983, abandoned.

[51] Int. Cl.[4] ..... B63H 11/103

[52] U.S. Cl. ..... 440/47; 60/221; 137/829; 239/265.17; 239/DIG. 7; 440/38

[58] Field of Search ..... 440/38, 44, 45, 47; 239/265.11, 265.17, 433, 423, 124, DIG. 7; 417/184; 60/221; 137/829

[56] References Cited

U.S. PATENT DOCUMENTS

| | | | |
|---|---|---|---|
| 2,730,065 | 1/1956 | Piper | 115/14 |
| 2,914,913 | 12/1959 | Zwicky | 440/45 |
| 3,116,598 | 1/1964 | Blake | 440/45 |
| 3,188,997 | 6/1965 | Christensen | 115/11 |
| 3,342,032 | 9/1967 | Cox et al. | 60/221 |
| 3,447,324 | 6/1969 | French | 60/221 |
| 3,503,410 | 3/1970 | Richards | 137/829 |
| 3,829,027 | 8/1974 | Mocarski | 239/DIG. 7 |
| 3,922,113 | 11/1975 | Turner | 417/184 |
| 4,073,613 | 2/1978 | Desty | 239/DIG. 7 |
| 4,099,908 | 7/1978 | Beckmann et al. | 239/DIG. 7 |

FOREIGN PATENT DOCUMENTS

| | | | |
|---|---|---|---|
| 2261926 | 9/1975 | France | 440/45 |
| 17410 | of 1903 | United Kingdom | 440/38 |

*Primary Examiner*—Joseph F. Peters, Jr.
*Assistant Examiner*—Thomas J. Brahan
*Attorney, Agent, or Firm*—Finnegan, Henderson, Farabow, Garrett and Dunner

[57] ABSTRACT

A marine propulsion water jet system which operates at high efficiency and automatically adjusts itself to maintain a relatively constant primary injection water velocity over a wide speed range. The propulsion system includes a fluid flow amplifier by which a high velocity principal water flow is injected into a slower velocity secondary water flow to form a water jet. The fluid flow amplifier includes an adjustable orifice through which the principal water flow is injected into the secondary water flow and the size of the orifice is automatically adjusted in order to maintain a relatively constant water jet velocity.

5 Claims, 4 Drawing Figures

MARINE PROPULSION SYSTEM

This application is a continuation of application Ser. No. 466,657, filed Feb. 15, 1983 abandoned.

BACKGROUND OF THE INVENTION

1. Field of the Invention

The present invention relates to a marine propulsion system, and, more specifically, to a water jet propulsion system utilizing a fluid flow amplifier.

2. Description of the Prior Art

Power driven water craft are generally propelled by either multibladed propellers or water jet drivers. While more exotic propulsion systems are available, they are not in widespread commercial use. Propeller and water jet drivers are relatively inefficient propulsion systems and are extremely energy intensive.

Marine propulsion systems basically operate over a widespread speed range. The drive efficiency of the marine propulsion system varies over the speed range to which the system is applied. The hull efficiency also varies over the marine propulsion speed range in a complex relationship between the two. Combining propulsion and hull efficiency variations results in combinations that have peak efficiency only at a single point or within a very narrow speed range. Various devices may be utilized to counteract this problem, such as variable pitch propellers, trim and tilt adjustments for thrust alignment, etc. These devices add complexity and cost to the system and their operation is most often subjectively controlled by the operator. Therefore, efficiency is related to the operator's skill in controlling the effect of these devices on the propulsion and hull system variations.

Fluid flow amplifiers are well-known in the fluid jet propulsion field. Such devices are used to move large volumes of fluid with relatively small input flows. Venturi ejectors and Canoda effect devices are fluid flow amplifiers which are known in the art. These devices generally make use of a high velocity, low volume stream to act upon and accelerate a larger fluid stream. The energy of the high velocity primary fluid stream is used to accelerate and eject a much larger volume of secondary fluid at an increased velocity, which velocity is lower than that of the low volume primary fluid stream. Fluid flow amplifiers, however, are subject to the same limitation as the conventional propeller and water jet driver propulsion systems of only delivering peak efficiency from an optimum combination of the propulsion and hull efficiency variation which lies only in a very narrow speed range.

SUMMARY OF THE INVENTION

It is therefore an object of the present invention to provide a marine propulsion system which will operate at high efficiency and automatically adjust itself to maintain high efficiency over a wide speed range.

The invention provides a marine propulsion system that utilizes a fluid flow amplifier wherein the orifice between the primary and secondary fluid streams is automatically adjusted so as to maintain a specific cross-sectional flow area in relationship to the fluid volume passing through it. The purpose of this compensating variable orifice is to maximize the velocity of the primary fluid at the point of entry into the secondary fluid flow where the primary fluid will act upon the secondary fluid. At any given flow rate of primary fluid (within the operating range) the variable orifice will adjust its open cross-sectional area so that the velocity across the orifice will be the maximum obtainable at a particular pressure level.

Additional objects and advantages of the invention will be set forth, in part, in the description which follows, will be obvious from the description, or may be learned by practice of the invention. The objects and advantages of the invention are realized and attained by means of the materials, methods and the combinations particularly pointed out in the appended claims.

To achieve the objects in accordance with the purposes of the invention, as embodied and broadly described herein, the invention involves a fluid flow amplifier for a marine propulsion water jet system which includes the injection of a high velocity principal water flow into a slower velocity secondary water flow to form a water jet. The fluid flow amplifier of the invention comprises an adjustable orifice through which the principal water flow is injected into the secondary water flow and a hydraulically balanced means for automatically adjusting the size of the orifice in order to maintain a relatively constant primary water injection velocity.

In a preferred embodiment, the fluid flow amplifier includes a water jet pod for channeling the secondary water flow, and the hydraulically balanced means includes a compensating annular sleeve mounted in the pod. The adjustable orifice includes an annular shoulder on the inner surface of the pod and an annular lip on one end of the sleeve interacting with the shoulder. The hydraulically balanced means also includes a primary annular chamber formed between the end of the sleeve having the lip and the pod for receiving the principal water flow, a secondary annular chamber formed between the other end of the sleeve and the pod, and at least one constricted water flow channel through the sleeve interconnecting the annular chambers. The lip is elongated and shaped to direct the principal water flow into the orifice, the sleeve is biased toward the orifice and a pressure control valve releases water from the secondary annular chamber to maintain hydraulic balance automatically in a predetermined range of pressure.

It is to be understood that both the foregoing general description and the following detailed description are exemplary and explanatory only and are not intended to be restrictive of the invention, as claimed.

The accompanying drawings, which are incorporated in and constitute a part of the specification, illustrate an example of a preferred embodiment of the invention and together with the description serve to explain the principles of the invention.

DETAILED DESCRIPTION OF THE INVENTION

Reference will now be made in detail to the present preferred embodiment of the invention, an example of which is illustrated in the accompanying drawings.

Figure 1:
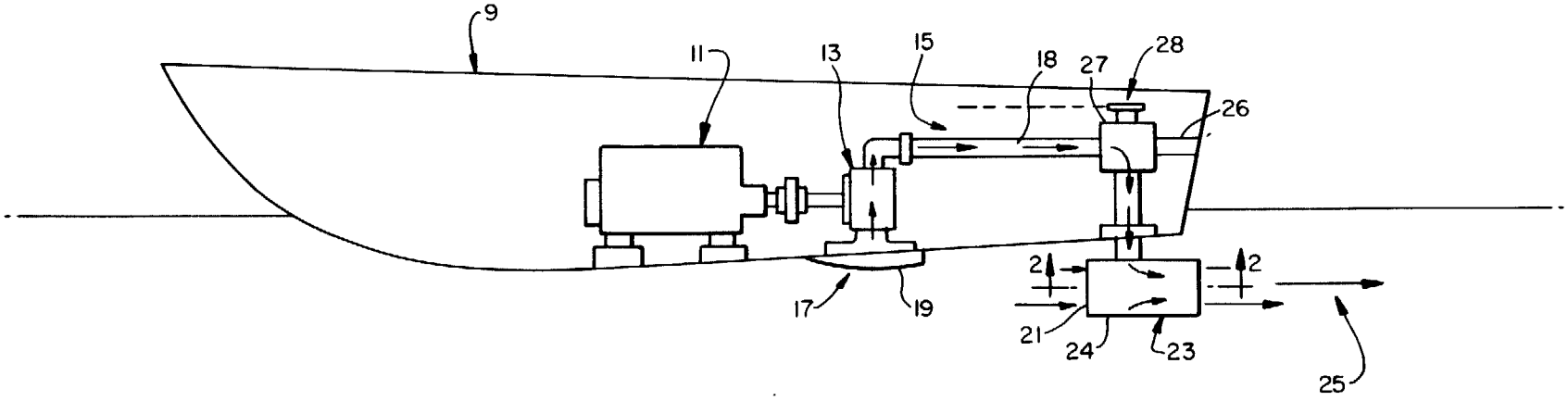
FIG. 1 is a side view of a water vehicle equipped with the marine propulsion device of the invention.

FIG. 1 is a side view of a water vehicle, numbered generally as 9, equipped with the marine propulsion device of the present invention. The marine propulsion system includes an engine 11, a pump 13 for delivering a primary water supply 17 into the marine propulsion system and a scoop 19 through which the primary water supply enters the system. A conduit 15 transports the primary water supply in the direction indicated by the arrows 18 under pressure from the pump 13 into the marine propulsion device numbered generally as 23. Secondary water supply 21 flows through an annular pod 24 of the marine propulsion device 23 and the combined primary and secondary water flow 25 exits the annular pod 24. The marine propulsion system may be secured by support means 26. The marine propulsion device 23 may be made to pivot by means of a rotary elbow 27 and steering mechanism means 28.

Figure 2:
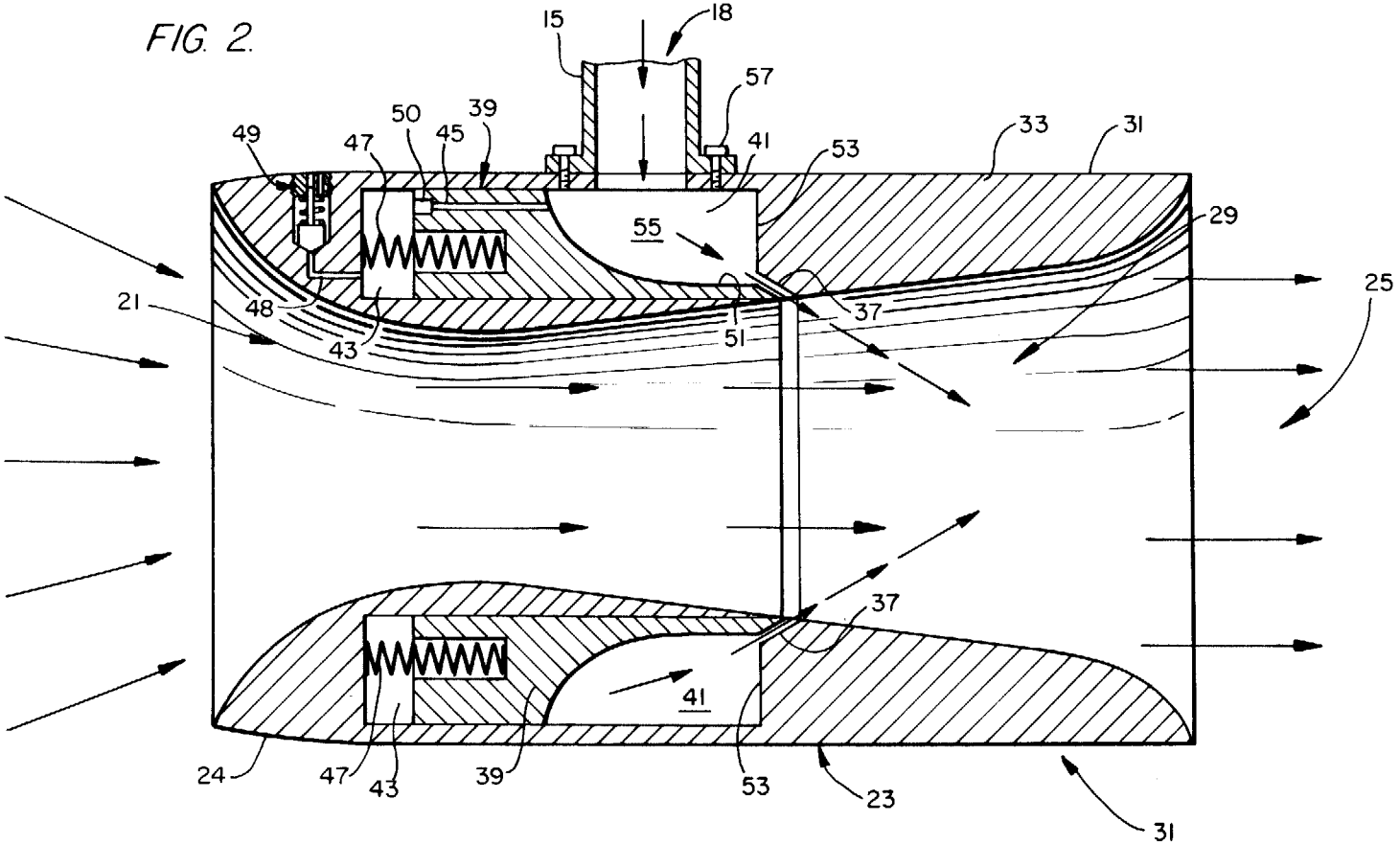
FIG. 2 is an enlarged cross-sectional view of the marine propulsion device taken along line 2--2 of FIG. 1.

FIG. 2 is a longitudinal cross-sectional view of the marine propulsion device 23 of FIG. 1. Within the pod 24, the marine propulsion device 23 includes a fluid flow amplifier, numbered generally as 31. The fluid flow amplifier includes an annular outer shell 33 and a venturi-type section, as its interior surface, through which the secondary waters flow. The tube has flaring ends connected by a relatively constricted middle portion into which the primary water supply is injected under high pressure from pump 13 through conduit 15 and an adjustable orifice 37, as explained hereinafter.

The fluid flow amplifier of the invention includes hydraulically balanced means for automatically adjusting the size of the orifice 37 so as to maintain a relatively constant water jet velocity. As embodied herein, the hydraulically balanced means includes a compensating annular sleeve 39 slidably mounted in pod 24, a first annular chamber 41 formed between the end of the sleeve adjoining the orifice and an inner surface of the pod, a second annular chamber 43 formed between the other end of the sleeve and an inner surface of the pod, at least one constricted water flow channel 45 between the annular chambers and a fluid pressure control valve 49 for releasing fluid from the second annular chamber at a predetermined water pressure.

In the preferred embodiment of the invention, compensating annular sleeve 39 is slidably positioned in an annular cavity in the pod 24 surrounding the venturi-type tube section through which the secondary water supply flows. The sleeve 39 is precisely fitted in the cavity so as to permit little, if any, water flow between the first chamber 41 and the second chamber 43 around the sleeve 39.

The first annular chamber 41 communicates directly with the conduit 15 through an opening in the shell of the pod 24. The conduit 15 can be rigidly, and watertightly, attached to pod 24 by any convenient means such as bolts 57.

The end of the sleeve 39 forming one wall of the first annular chamber 41 is shaped and elongated opposite the conduit 15 into a lip 51 for directing the primary water flow into the adjustable orifice 37. Preferably the lip 51 includes a continuous curve beginning with the outer surface of the sleeve adjoining the cavity in the pod and approaching the adjustable orifice 37. Preferably also, the curve forming the lip 51 is annular for directing the primary water flow into the annular lip, whereby there is a 360° injection of the primary water flow into the secondary water supply.

The adjustable orifice 37 according to the invention is positioned between the end of the lip 51 and a shoulder 53 on the inner surface of the pod 24. Preferably the edge of the lip 51 is slanted into a specific angle and a complementary angle is formed on the shoulder 53 opposite the edge of the lip. The angle of the orifice ejects the primary water flow in a conical sheet into the secondary water supply for fluid flow amplification. Although the angle of the lip with respect to the directions of flow of the secondary water may be selected for a variety of conditions, it is believed that an angle of 30° would be suitable.

The slope of the curve of the lip should also be adjusted with a change in the angle of the orifice to achieve maximum thrust of the primary water through the adjustable orifice.

Figure 3:
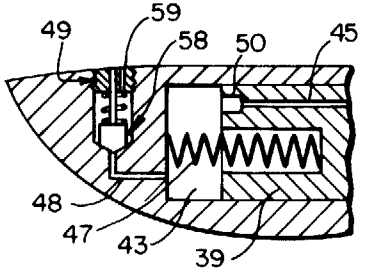
FIG. 3 is a detailed depiction of the pressure sensitive orifice adjusting means shown more generally in FIG. 2.

FIG. 3 shows with greater detail the pressure sensitive orifice adjusting means of the preferred embodiment of the invention. When the throttle (not shown) of engine 11 is advanced the volumetric flow from pump 13 will be increased. Instantaneously, the pressure within chamber 55 will begin to rise. This increasing pressure will be communicated through channel 45, orifice 50, chamber 43, channel 48 and will act upon pressure relief valve 49. The pressure within all of the passages and chambers is effectively uniform at this instant. The pressure will continue to rise since all fluid outlet paths are blocked at this time. When the pressure has risen to the level required to unseat the poppet 58 of valve 49, a small amount of fluid will flow out of orifice 59, thereby reducing the pressure within chamber 43. The force acting on the projected area of compensating sleeve 39, within chamber 43 will now be reduced. Since the small amount of flow through orifice 59 will not substantially reduce the pressure within chamber 55, the force acting on the projected area of sleeve 39, within chamber 55, will remain substantially constant. An unbalanced condition now exists wherein the force acting upon the chamber 55 side of sleeve 39 is greater then the combined force of spring 47 plus the force acting upon the chamber 43 side of sleeve 39. Sleeve 39 will now move toward the left, as shown in FIG. 2, until the increasing force of spring 47 is raised to the level where an equilibrium condition of the forces on both side of sleeve 39 exists.

Movement, toward the left, of sleeve 39 has now caused orifice 37 to open. A flow of high pressure primary fluid is now injected into the central region of the fluid amplifier, which accelerates and ejects secondary fluid towards the exit.

In essence, the structure of the device is such that relief valve 49 acts to control the pressure within chamber 55 and therefore the fluid velocity across orifice 37.

The constricted water flow channel 45 permits minor changes in pressure between the annular chambers 41 and 43 to come into balance gradually.

The marine propulsion system of the present invention provides several benefits not found in previous systems. The compensating adjustable orifice maximizes the velocity of the primary fluid flow at the point of entrance into the secondary fluid chamber. At any given flow rate of the primary fluid, within its operating range, the adjustable orifice will adjust this area so that the velocity across the orifice will be a maximum obtainable at that particular pressure level.

When the flow of the primary fluid is reduced, the orifice will be adjusted under the force of the springs 47 so that the orifice area is also reduced. When there is an increase in the flow of the primary fluid the adjustable orifice will increase its orifice area as stated above. In this way, the adjustable orifice will compensate for the rate of flow so that the velocity across the orifice of the primary fluid will remain relatively constant. The orifice area is then directly related to the pressure in the first annular chamber, which is related to the flow of the primary fluid. The volume of the primary fluid entering the secondary fluid chamber is therefore adjusted to permit continued efficient operation of the marine propulsion device.

The pod may be attached in such a manner to be rotatable with respect to the centerline of the vessel in order to facilitate steering by directing the exiting fluid stream at an angle to the centerline. The pod may also be rotated so as to direct thrust towards the bow of the vessel in order to obtain movement of the vessel in reverse.

The pod may also be attached in such a manner as to allow angular adjustment with respect to the transom of the vessel. This adjustment, which may be accomplished by hydraulic or mechanical means, will allow trim adjustment of thrust with respect to the horizontal.

Figure 4:
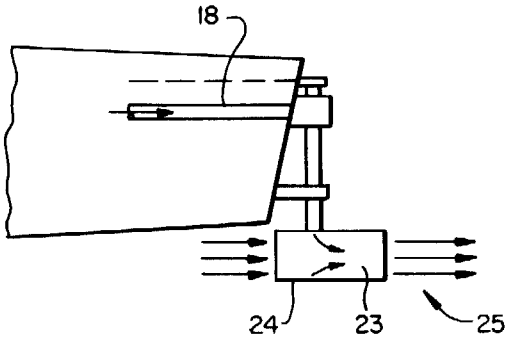
FIG. 4 is a broken side view of an alternative attachment position through the hull adjacent the stern of a vessel of an embodiment of the marine propulsion system.

Other embodiments of the invention will be apparent to those skilled in the art in consideration of the specification and practice of the invention disclosed herein. For example, the pod of the marine propulsion device may be affixed to a vessel by attachment through the hull adjacent to the stern as shown in FIG. 1 or may be attached outboard of the transom as shown in FIG. 4. It is intended that the specification be considered as exemplary only, with a true scope and spirit of the invention being indicated by the following claims.

What is claimed is:

1. A fluid flow amplifier for a marine propulsion water jet system including the injection of a high velocity principal water flow into a slower velocity secondary water flow to form a water jet, said amplifier comprising:

an adjustable orifice through which said principle water flow is injected into said secondary water flow;

hydraulically balanced means for automatically adjusting the size of said orifice so as to maintain relatively constant primary water injection velocity;

a water jet pod for channeling said a secondary water flow, wherein said hydraulically balanced means includes a compensating annular sleeve mounted in said pod, and said adjustable orifice includes an annular shoulder on the inner surface of said pod and a lip on one end of said annular sleeve interacting with the shoulder, and wherein said hydraulically balanced means also includes a primary annular chamber formed between the end of said sleeve including said lip and said pod for receiving said principal water flow, a secondary annular chamber formed between the other end of said sleeve and said pod, and a constricted water flow channel interconnecting said annular chamber through said sleeve.

2. The fluid flow amplifier according to claim 1, wherein said hydraulically balanced means also includes spring means for biasing said sleeve toward closing said adjustable orifice, and a pressure control valve responsive to the water pressure in said secondary annular chamber for controlling the release of water from said secondary annular chamber.

3. The fluid flow amplifier according to claim 2, wherein said spring means includes individual compression springs positioned between said other end of said sleeve and said pod.

4. The fluid flow amplifier according to claim 2, wherein said lip is elongated and shaped for directing said principal water flow into said adjustable orifice.

5. The fluid flow amplifier according to claim 2, wherein said pressure control valve includes a maximum pressure limit for opening the valve and a minimum pressure limit for closing the valve.

* * * * *

UNITED STATES PATENT AND TRADEMARK OFFICE

CERTIFICATE OF CORRECTION

PATENT NO. : 4,718,870

DATED : January 12, 1988

INVENTOR(S) : LEONARD WATTS

It is certified that error appears in the above-identified patent and that said Letters Patent is hereby corrected as shown below:

Claim 1: Column 6, Line 7; after "maintain" insert the word --a--.

Signed and Sealed this

Twenty-first Day of June, 1988

*Attest:*

DONALD J. QUIGG

*Attesting Officer*

*Commissioner of Patents and Trademarks*